US005415123A

United States Patent [19]

Ryder

[11] Patent Number: 5,415,123

[45] Date of Patent: May 16, 1995

[54] WEB MARKING DEVICE

[76] Inventor: Robert Ryder, 141 Seminary Dr., P, Mill Valley, Calif. 94941

[21] Appl. No.: 209,429

[22] Filed: Mar. 10, 1994

Related U.S. Application Data

[62] Division of Ser. No. 37,925, Mar. 26, 1993, Pat. No. 5,305,707.

[51] Int. Cl.[6] ..... G09F 3/10; G08B 5/02

[52] U.S. Cl. ..... 116/281

[58] Field of Search ..... 116/200, 281, 283, 282; 83/367, 923, 522.11, 522.12, 522.13; 118/713

[56] References Cited

U.S. PATENT DOCUMENTS

| | | | |
|---|---|---|---|
| 2,094,454 | 9/1937 | Keville | 206/59 |
| 3,463,515 | 8/1969 | Thompson | 283/37 |
| 3,670,615 | 6/1972 | Scholl | 83/367 |
| 3,747,242 | 7/1973 | Heimann | 40/2 R |
| 3,805,426 | 4/1974 | Cunningham | 40/2 R |
| 4,161,249 | 7/1979 | Dashow | 206/459 |
| 4,201,403 | 5/1980 | Turner | 283/21 |
| 4,204,012 | 5/1980 | Brocklehurst et al. | 118/42 X |
| 4,700,627 | 10/1987 | Hagler | 101/426 |
| 5,305,707 | 4/1994 | Ryder | 116/281 |

*Primary Examiner*—William A. Cuchlinski, Jr.
*Assistant Examiner*—Willie Morris Worth
*Attorney, Agent, or Firm*—Dergosits & Noah

[57] ABSTRACT

A special marker is disclosed that is affixed to a stationary or moving web near the lateral web edge to designate defective material. When edge trim is removed from the web, the trim removal device also cuts-off the front end of the marker so that the remaining portion is momentarily flush with the new web edge. This cutting action activates the remaining portion of the marker so that a component of the marker advances to extend out beyond the new web edge such that it is visible after the marker is wound into the rewind roll. This ability to see where the web was initially marked, after edge trim is removed, eliminates the conventional inaccurate and wasteful practice of remarking the web.

2 Claims, 6 Drawing Sheets

WEB MARKING DEVICE

This is a divisional of application Ser. No. 08/037,925, filed Mar. 26, 1993, now U.S. Pat. No. 5,305,707.

BACKGROUND OF INVENTION

1. Field of the Invention

The present invention is a web marker that remains visible after lateral edge trim is removed from the web and after the web is wound into the rewind roll thereby eliminating the need for the conventional and inaccurate practice of remarking the web.

2. Discussion of the Prior Art

Presently, operators of web processing machines insert markers in the rewinding rolls to designate where defective material begins and/or ends. Conventional markers are often the size and shape of typical rectangular bookmarkers and their front end extends out beyond the edge of the web so it can be seen in the rewind roll. The problem with this approach is that during subsequent web processing operations, the marker either falls out of the unwinding roll or the front end of the marker is cut-off by the trim removal device so the marker is not visible after the web is again wound into the rewind roll. Consequently, the web must be remarked. Such remarking is an inaccurate process that results in excess waste.

To remark the web, the machine operator must keep track of when the markers fall out of the unwinding roll or when they are cut-off by the trim removal device so that he can estimate when that point on the web reaches the rewind roll at which time he inserts another marker in the roll. This is an inaccurate process that results in waste. Furthermore, it is not unusual for the operator to be involved in other duties and to fail to even see the marker as it comes due for remarking.

Once the initial markers are positioned on the web it is important that their specific location not be changed during subsequent machine processing because, during the final web processing stages, the markers will be used to determine what web material to discard as waste and what web material to keep as good product. If the web is remarked too soon or too late it can result in good material being discarded as waste and defective material being shipped to customers.

Web processors discard millions of pounds of good web material as waste each year because of inaccurate remarking. Similarly, inaccurate remarking results in defective web material escaping detection and being shipped to customers.

SUMMARY

The present invention provides a special marker that is affixed to a stationary or moving web near the lateral web edge to designate defective material. When edge trim is removed from the web, the trim removal device also cuts-off the front end of the marker so that the remaining portion is momentarily flush with the new web edge. This cutting action activates the remaining portion of the marker so that a component of the marker advances to extend out beyond the new web edge such that it is visible after the marker is wound into the rewind roll.

The marker of the present invention will thereby reduce waste and defective product sent to customers, providing an effective marking device that eliminates the need to remark the web after the edges are trimmed.

BRIEF DESCRIPTION OF THE DRAWINGS

FIG. 1A shows prior art and FIG. 1B shows application of the present invention.

FIG. 3A shows the marker prior to activation and FIG. 3B shows it after activation.

FIG. 5A shows the marker prior to activation and FIG. 5B shows it after activation.

FIG. 7A shows the marker prior to activation and FIG. 7B shows it after activation.

FIG. 9A shows the marker prior to activation and FIG. 9B shows it after activation.

FIG. 11A shows the marker prior to activation and FIG. 11B shows it after activation.

DETAILED DESCRIPTION OF THE INVENTION

Figure 1A:
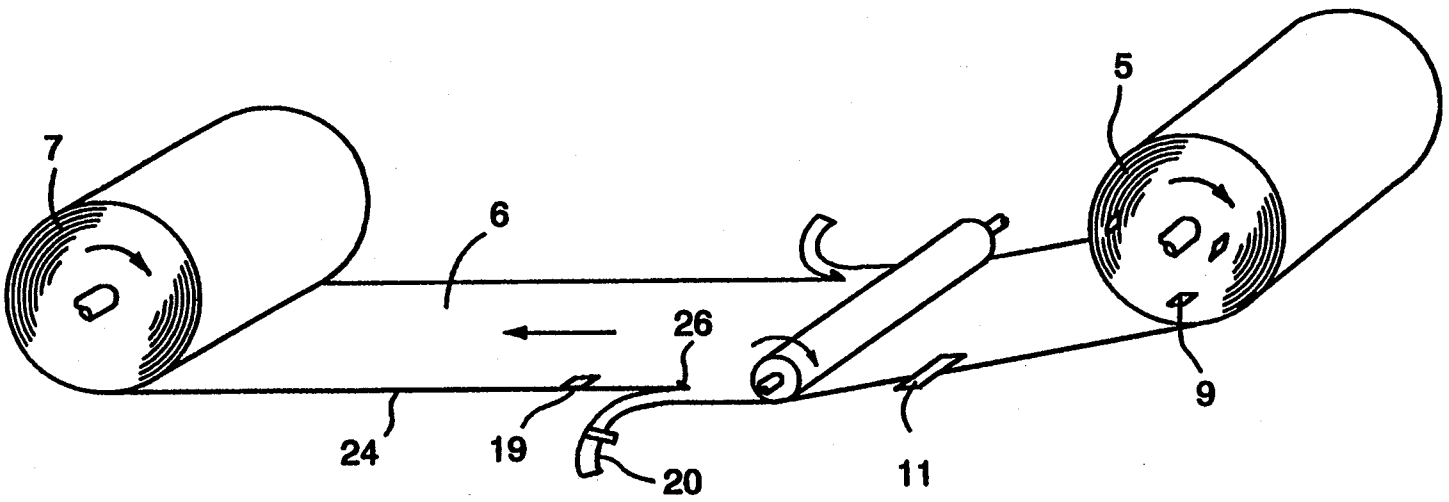
(PRIOR ART) FIG. 1A
FIG. 1A and 1B are schematics of a simplified web processing machine in operation.

In FIG. 1A, (labelled PRIOR ART) the web 6 from the unwind roll 5 is traveling across a simplified web processing machine and is being rewound into roll 7. Conventional web marker 9 is shown in the unwind roll 5 and is similar to the other markers shown in roll 5. Marker 11 shows what marker 9 looks like after it unwinds with the web to which it is adhered. Marker 19 is what marker 11 looks like after the trim removal device 26 cuts-off the portion of marker 11 that extended out beyond the trimmed edge 24. The remaining portion of marker 19 travels with the web and is wound into the rewind roll 7 leaving no visible indication where the web was marked.

Although marker 9 is described here as adherent to the web, many conventional markers have no adhesive.

Consequently they inadvertently fall loosely from the unwind roll and web as they unwind. Here again, this results in no visible indication in the rewind roll as to where the web was marked. In order to have a visible indication using conventional markers, the machine operator must manually remark the web.

To manually remark the web, the operator must keep track of when the markers fall out of the unwinding roll or when they are cut-off by the trim removal device so that he can estimate when that point on the web reaches the rewind roll. At that moment he inserts another marker in the rewinding roll or applies another marker to the web so that the front portion extends out beyond the edge of the rewind roll. This manual remarking process is inaccurate and often results in good material being discarded as waste and defective material being shipped to customers. Further, it is not unusual for the operator to be involved with other duties and fail to even see the marker as it comes due for remarking.

Figure 1B:
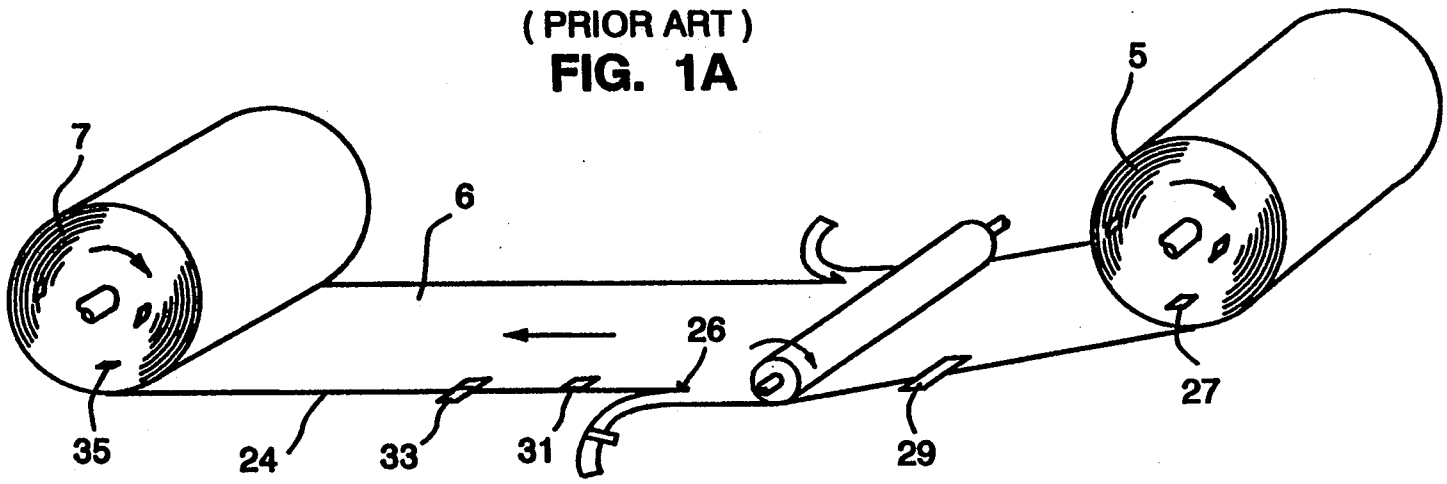

FIG. 1B is similar to FIG. 1A except the marker according to the present invention is employed. The web 6 from the unwind roll 5 is traveling across a simplified web processing machine and is being rewound into roll 7. Invention web marker 27 is shown in the unwind roll 5 and is similar to the other markers shown in roll 5. Marker 29 shows what marker 27 looks like after it unwinds with the web to which it is adhered. When marker 29 reaches the trim removal device 26, the device 26 cuts-off the portion of marker 29 that extended out beyond the trimmed edge 24. The remaining portion of marker 29 is momentarily flush with the new web edge 24 as shown in marker 31. This cutting action activates marker 31 so that a component advances to extend out beyond the new web edge 24. Marker 33 shows what marker 31 looks like after this process. Marker 33 travels with the web and is wound into rewind roll 7. Marker 35 shows what marker 33 looks like after being wound into the rewind roll. The end of marker 35 is visible in rewind roll 7 and indicates where the web was originally marked.

Figure 2:
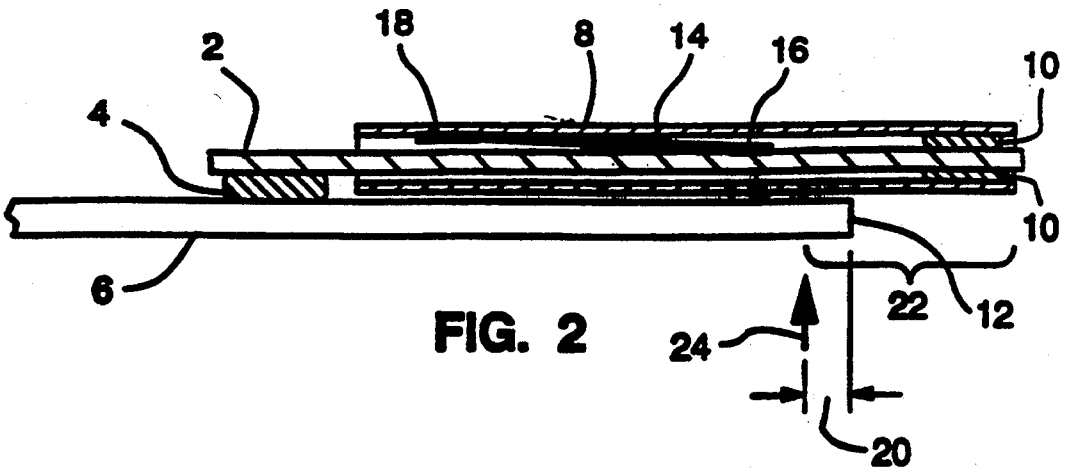
FIG. 2 is a view in vertical cross-section of one embodiment of the present invention wherein the inner portion of the marker is anchored to the web material and the outer sleeve moves relative to the inner portion.

For illustrative purposes only, and without intending to limit the scope of the invention, some specific embodiments of the invention will be described below:

FIG. 2 shows an embodiment of the invention, prior to edge trimming, where the inner platform 2 is anchored with an adhesive 4 to the web 6 and the outer sleeve 8 moves upon activation. The outer sleeve 8 is affixed to the inner platform 2 by an adhesive or fastener 10 at the front end of the marker which extends out beyond the web edge 12. A stretched elastic strip 14 is anchored to the inner platform 2 at point 16 and to the outer sleeve at point 18. As the trim 20 is cut-off, the trim removal device also cuts-off the portion 22 of the marker that extended out beyond the trim line 24. When this happens the outer sleeve 8 is no longer affixed to the inner platform 2 and the stretched elastic strip 14 moves the outer sleeve 8 so that it extends out beyond the trim line 24 or trimmed web edge. During manufacture of the marker, the outer sleeve 8 can be wrapped around the inner platform 2 to achieve a sliding relationship between the inner platform 2 and the outer sleeve 8.

Figure 3A:
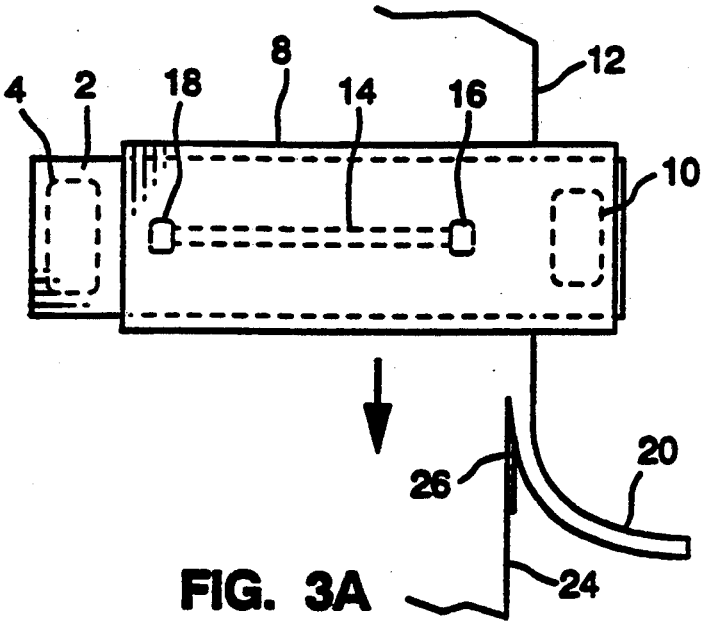
FIG. 3A and 3B are top plan views of the embodiment of the present invention wherein the inner portion is anchored and the outer sleeve moves.
Figure 3B:
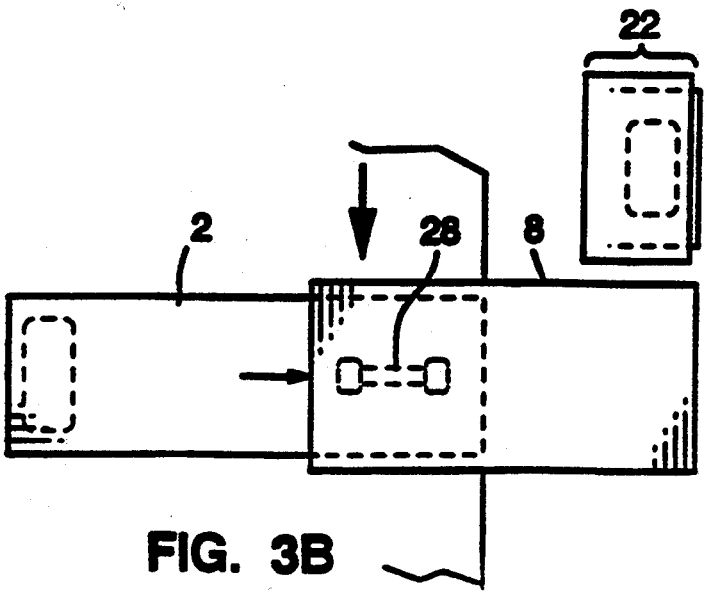

The same embodiment as FIG. 2 is shown in FIG. 3A and 3B as top plan views. FIG. 3A shows the marker prior to activation and FIG. 3B shows it after activation. As the web travels, the trim removal device 26 cuts-off the portion 22 of the marker that extended out beyond the trim line 24. The stretched elastic strip 14 now moves the outer sleeve 8 so that it extends out beyond the trimmed web edge 24 as the elastic becomes a relaxed strip 28.

Figure 4:
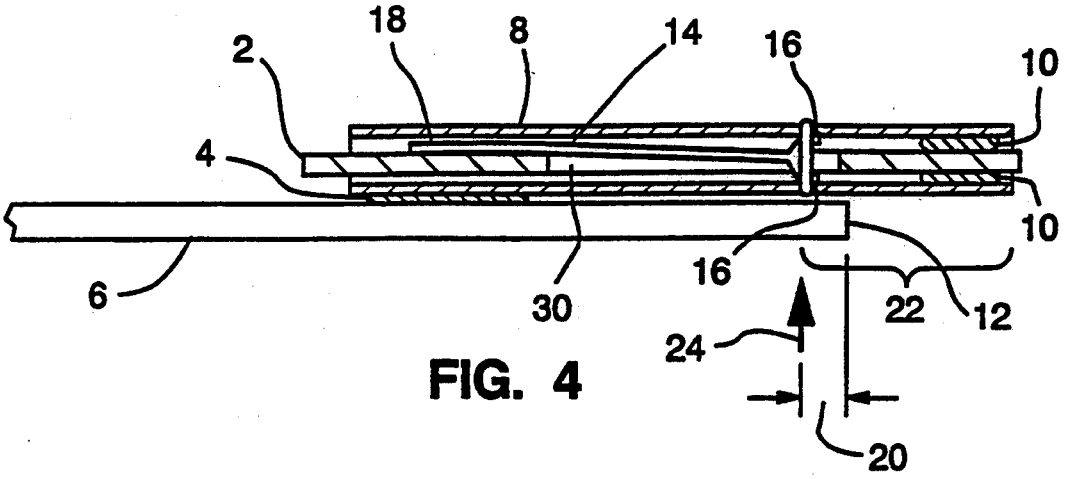
FIG. 4 is a view in vertical cross-section of another embodiment of the present invention wherein the inner portion of the marker moves and the outer sleeve is anchored.

FIG. 4 shows an embodiment of the invention, prior to edge trimming, where the inner platform 2 moves upon activation and the outer sleeve 8 is anchored with an adhesive 4 to the web 6. The inner platform 2 is affixed to the outer sleeve 8 by an adhesive or fastener 10 at the front end of the marker which extends out beyond the web edge 12. A stretched elastic strip 14 is anchored to the inner platform 2 at point 18 and to the outer sleeve at point 16. As the trim 20 is cut-off, the trim removal device 26 also cuts-off the portion 22 of the marker that extended out beyond the trim line 24. When this happens the outer sleeve 8 is no longer affixed to the inner platform 2 and the stretched elastic strip 14 moves the inner platform 2 so that it extends out beyond the trim line 24. When this embodiment is manufactured, the outer sleeve 8 can be wrapped around inner platform 2.

In the embodiments shown so far, the ends of the elastic strip 14 can be anchored so that the elastic strip 14 passes through the inner platform 2. In such cases an elongated cut out 30 can be made in the inner platform 2 to allow either the inner platform 2 or the outer sleeve 8 to slide without interference from the anchors or elastic strip 14. Also, the outer sleeve 8 shown in the embodiments so far can be replaced with a single ply of material for an alternate marker construction.

Figure 5A:
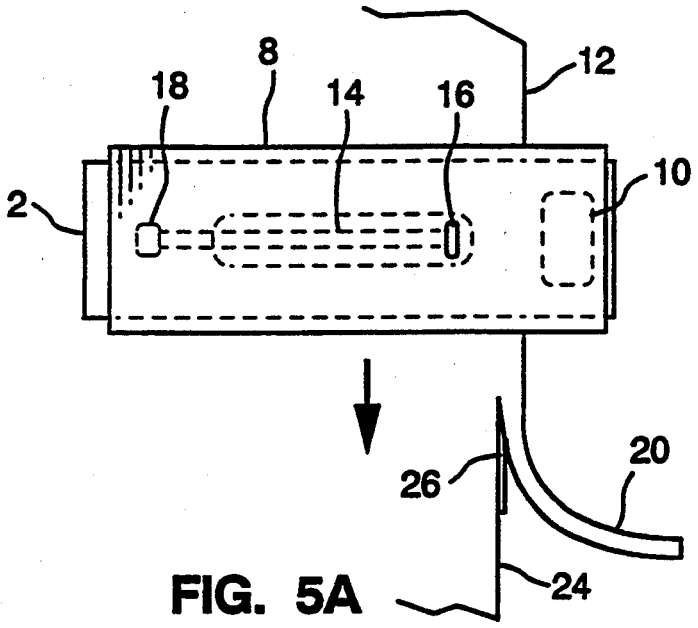
FIG. 5A and 5B are top plan views of the embodiment of the present invention wherein the inner portion moves and the outer sleeve is anchored.
Figure 5B:
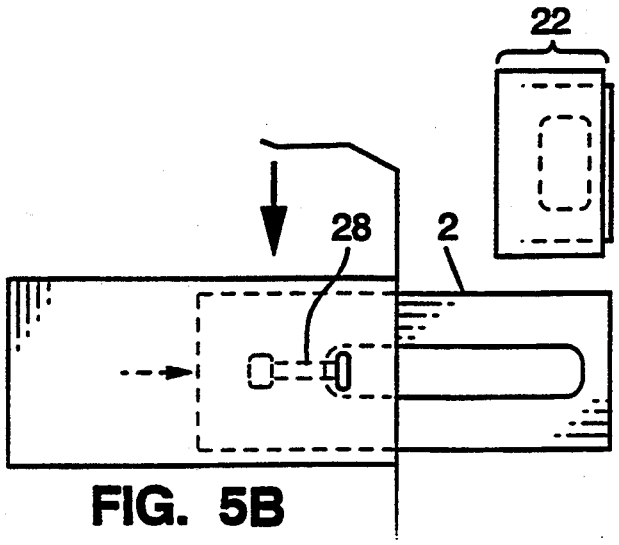

The same embodiment as FIG. 4 is shown in FIG. 5A and 5B as top plan views. FIG. 5A shows the marker prior to activation and FIG. 5B shows it after activation. As the web travels, the trim removal device 26 cuts-off the portion 22 of the marker that extended out beyond the trim line 24. The stretched elastic strip 14 now moves the inner platform 2 so that it extends out beyond the trimmed web edge 24 as the elastic becomes a relaxed strip 28.

Figure 6:
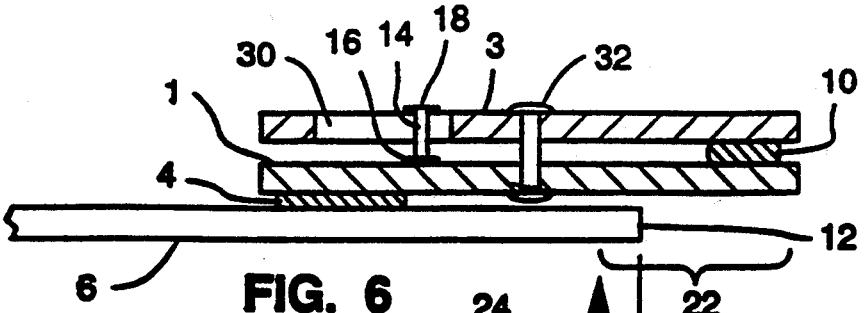
FIG. 6 is a view in vertical cross-section of an embodiment of the present invention comprised of a disc-like marker with a rotating bias.

FIG. 6 shows an embodiment of the invention, prior to edge trimming, where the bottom disc 1 is anchored with an adhesive 4 to the web 6 and the upper disc 3 rotates upon activation. The upper disc 3 is affixed to the bottom disc 1 by an adhesive or fastener 10 at the front end of the marker which extends out beyond the web edge 12. A stretched elastic strip 14 is anchored to the bottom disc 1 at point 16 and to the upper disc 3 at point 18. As the trim 20 is cut off, the trim removal device also cuts-off the portion 22 of the marker that extended out beyond the trim line 24. When this happens the upper disc 3 is no longer affixed to the bottom disc 1 and the stretched elastic strip 14 causes the upper disc 3 to rotate around the pivot point 32 so that it extends out beyond the trim line 24. The elongated cut out 30 in the upper disc 3 allows it to rotate without interference from the anchors or elastic strip 14. The anchors for the elastic strip 14, however, can both be located between the two discs so that a cut out is not needed.

Figure 7A:
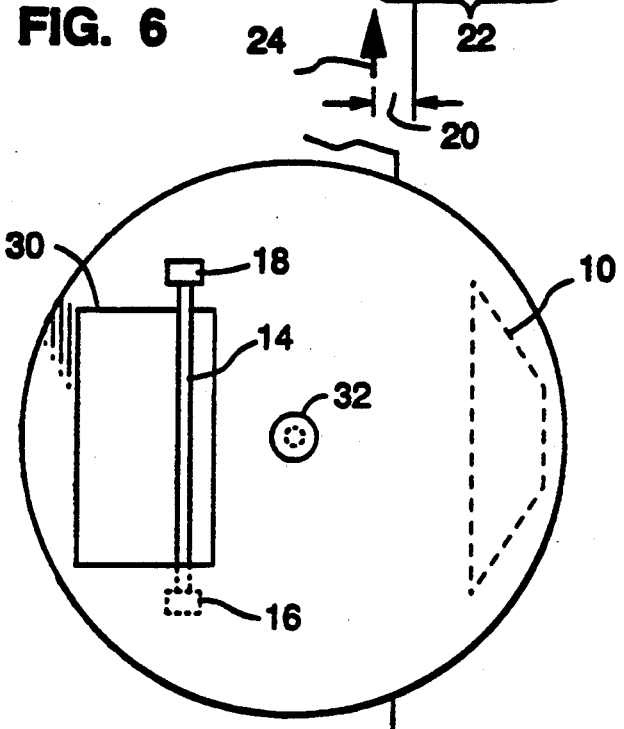
FIG. 7A and 7B are top plan views of the embodiment of the present invention comprised of a disc-like marker with a rotating bias.
Figure 7B:
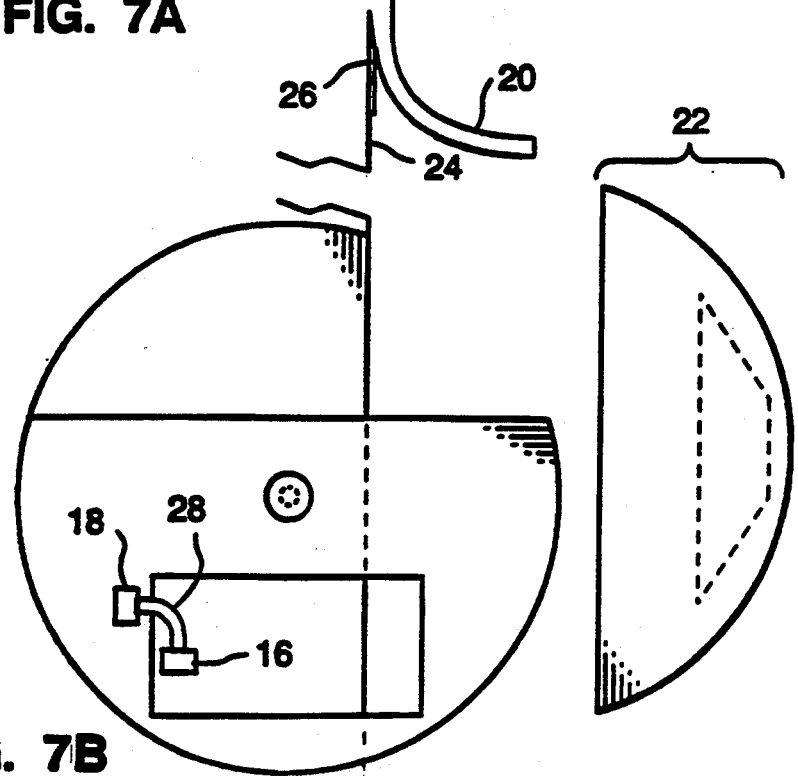

The same embodiment as FIG. 6 is shown in FIG. 7A and 7B as top plan views. FIG. 7A shows the marker prior to activation and FIG. 7B shows it after activation. As the web travels, the trim removal device 26 cuts-off the portion 22 of the marker that extended out beyond the trim line 24. The stretched elastic strip 14 now causes the upper disc 3 to rotate around pivot point 32 so that it extends out beyond the trimmed web edge 24 as the elastic becomes a relaxed strip 28.

To cover or protect the upper disc and elastic strip a top disc may be added to the construction. It can either rotate with the now middle disc or be anchored to the bottom disc.

Figure 8:
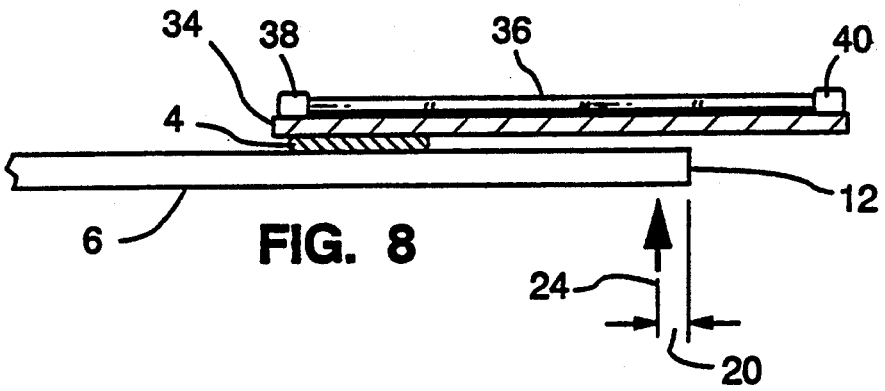
FIG. 8 is a view in vertical cross-section of another embodiment of the present invention comprised of a compressed spring anchored to a platform.

FIG. 8 shows an embodiment of the invention prior to edge trimming where the platform 34 is anchored with an adhesive 4 to the web 6 and a compressed spring 36 anchored to the platform 34 expands upon activation. The compressed spring 36 is anchored to the platform 34 at the rear end of the marker at point 38 and at the front end of the marker at point 40 which is out beyond the web edge 12.

As the trim 20 is cut off, the trim removal device also cuts-off the portion 22 of the marker that extended out beyond the trim line 24. When this happens the compressed spring 36 anchored at point 38 expands out beyond the trim line 24 into a decompressed spring. The compressed spring 36 may have a ribbon attached to it so that after expanding, the ribbon makes the portion of the spring extending out beyond the trim line 24 highly visible.

Figure 9A:
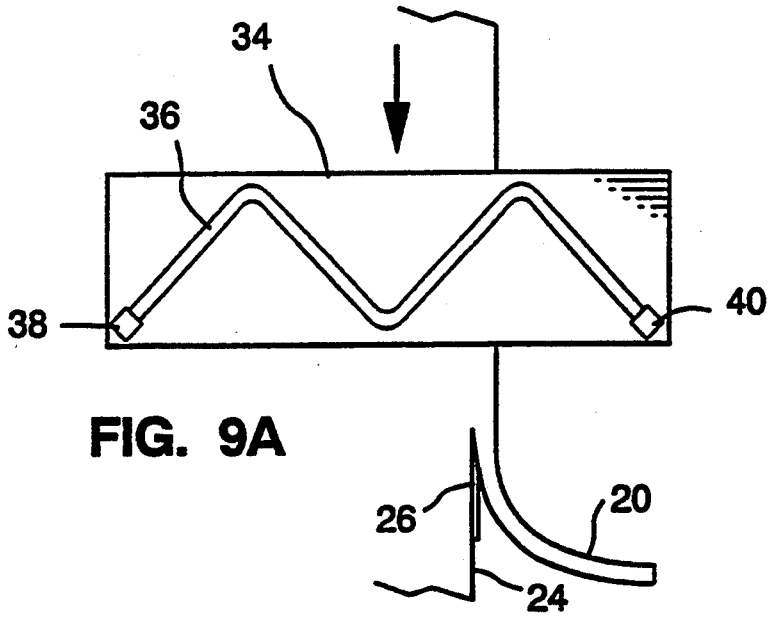
FIG. 9A and 9B are top plan views of the embodiment of the present invention comprised of a compressed spring anchored to a platform.
Figure 9B:
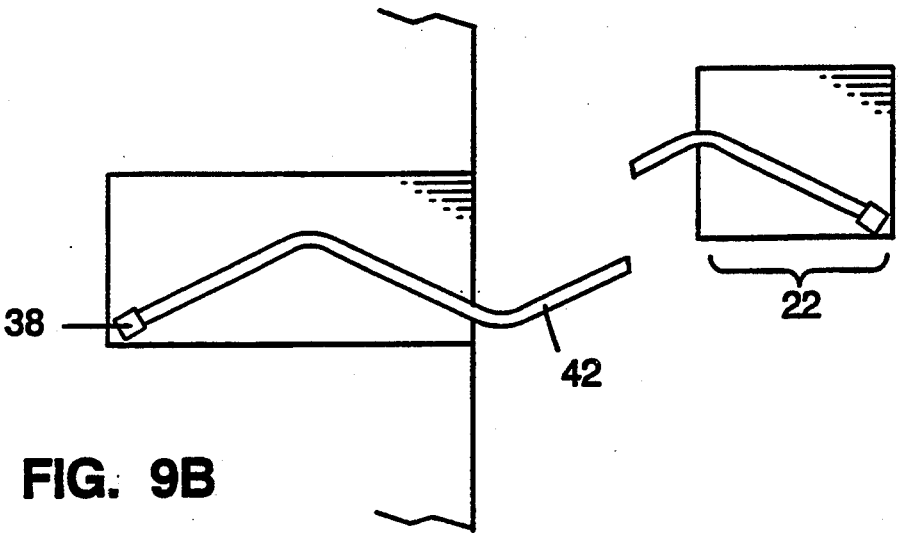

The same embodiment as FIG. 8 is shown in FIG. 9A and 9B as top plan views. FIG. 9A shows the marker prior to activation and FIG. 9B shows it after activation. As the web travels, the trim removal device 26 cuts-off the portion 22 of the marker that extended out beyond the trim line 24. The compressed spring 36 expands so that it extends out beyond the trimmed web edge 24 into a decompressed spring 42.

Figure 10:
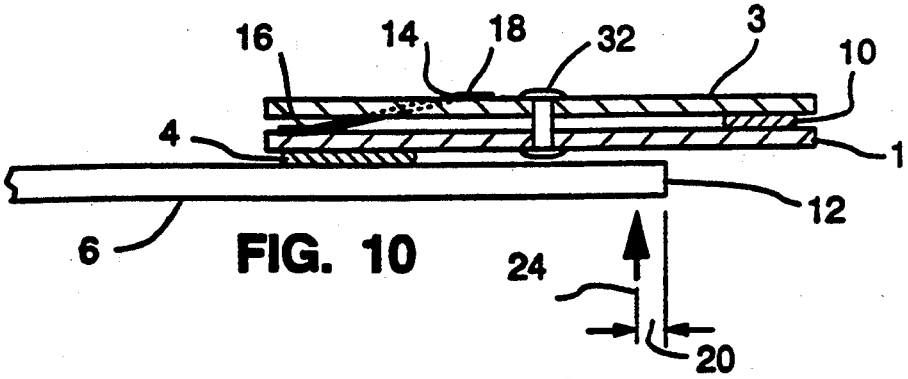
FIG. 10 is a view in vertical cross-section of an embodiment of the present invention comprised of a cross-like marker with a rotating bias.

FIG. 10 shows an embodiment of the invention prior to edge trimming where the bottom cross 1 is anchored with an adhesive 4 to the web 6 and the upper cross 3 rotates upon activation. The upper cross 3 is affixed to the bottom cross 1 by an adhesive or fastener 10 at the front end of the marker which extends out beyond the web edge 12. A stretched elastic strip 14 is anchored to the bottom cross 1 at point 16 and to the upper cross 3 at point 18. As the trim 20 is cut-off, the trim removal device 26 also cuts-off the portion 22 of the marker that extended out beyond the trim line 24. When this happens the upper cross 3 is no longer affixed to the bottom cross 1 and the stretched elastic strip 14 causes the upper cross to rotate around the pivot point 32 so that it extends out beyond the trim line 24.

Figure 11A:
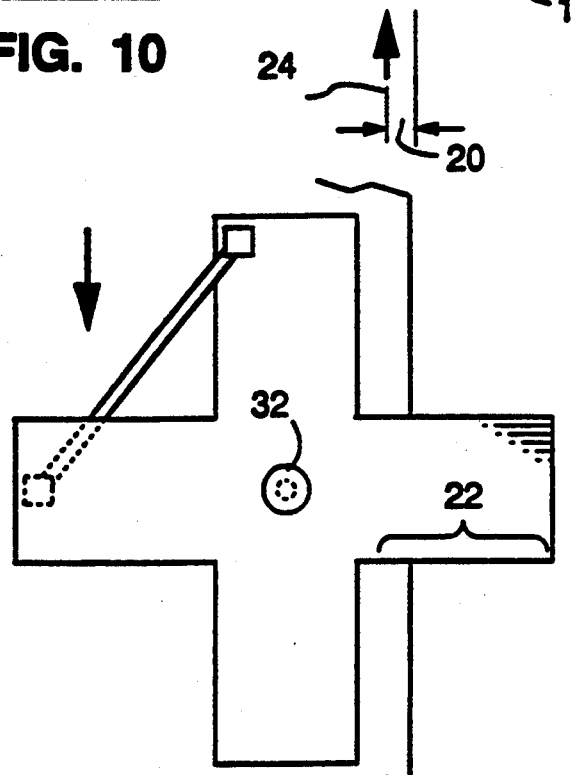
FIG. 11A and 11B are top plan views of the embodiment of the present invention comprised of a cross-like marker with a rotating bias.
Figure 11B:
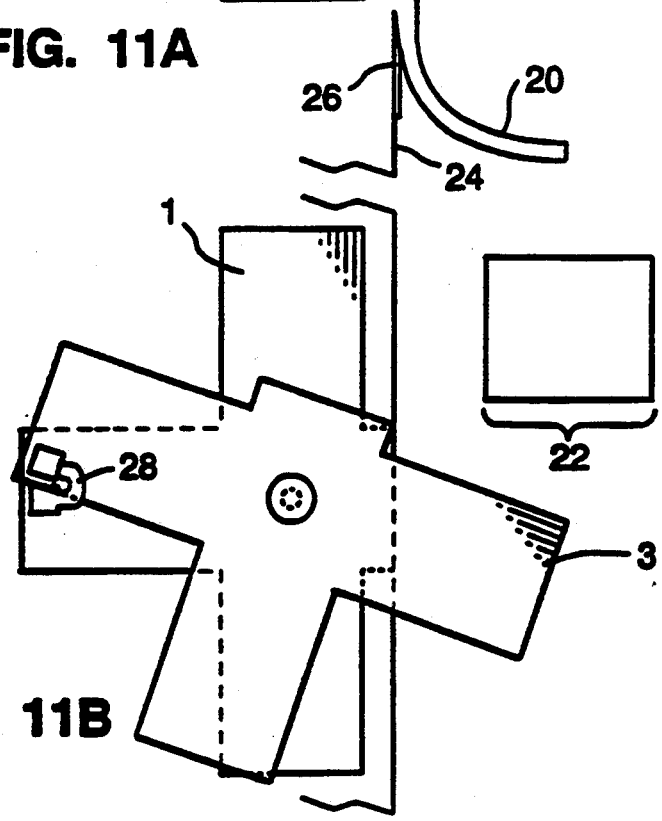

The same embodiment as FIG. 10 is shown in FIG. 11A and 11B as top plan views. FIG. 11A shows the marker prior to activation and FIG. 11B shows it after activation. As the web travels, the trim removal device 26 cuts-off the portion 22 of the marker that extended out beyond the trim line 24. The stretched elastic strip 14 now causes the upper cross 3 to rotate around pivot point 32 so that it extends out beyond the trimmed web edge 24 as the elastic becomes a relaxed strip 28.

The cross embodiment can function by eliminating one arm or two adjacent arms of the cross. Eliminating two arms results in an L-shaped marker. In this case one end of the stretched elastic strip would be anchored to the bottom maker arm that extends out beyond the trim line although the strip would be anchored inside the trim line. The other end of the stretched elastic strip would be anchored to the adjacent top marker arm which is located inside the trim line before activation. In a similar manner, the embodiment shown in FIG. 6 can function with a half-disc or quarter-disc shaped marker.

In the embodiments shown in FIG. 2 and 4, the marker, to function properly, needs to be positioned on the web so that the trim line is between the adhesive or fastener 10 and the front anchor point 18 of the elastic strip 14. To help guide machine operators in positioning the markers, the range can be noted on the marker where the edge of the web should cross it.

Some webs are processed two or more times across machines that take trim. Fortunately, the invention marker can be designed so that it only activates after the last trim taking operation prior to being processed on a slitting machine or other finishing machine. This feature will insure the markers are visible on the unwind roll during the processing operation when the defective material is removed.

The invention marker can be used to designate material that is to be removed, separated, counted, measured or otherwise processed.

While the present invention has been described with reference to preferred embodiments, those of skill in the art will recognize that variations and modifications can be made to these embodiments while still within the scope of the claims.

I claim:

1. An elongate device for continuously marking a location on a web having lateral edges, said web subject to trimming along at least one of its lateral edges, said device comprising:

a) anchor means for anchoring the elongate device to said web such that the longitudinal axis of said device is substantially perpendicular to said web lateral edge; and, b) marker means for providing a continuous mark on said web lateral edge disposed on the surface of the elongate device, the marker means fastened at its two ends to the elongate device such that the marker means is under compression wherein, during trimming of the web lateral edge, one end of the marker means is trimmed off allowing the marker means to extend, because of the releasable compressive force, in a direction along the device longitudinal axis causing said marking means to extend beyond the trimmed web lateral edge.

2. The device of claim 1 wherein said marker means is a spring in compression.

* * * * *